US007036766B2

(12) United States Patent
Place et al.

(10) Patent No.: US 7,036,766 B2
(45) Date of Patent: May 2, 2006

(54) REUSABLE COLLAPSIBLE CORE

(75) Inventors: James S. Place, Concord, NH (US); Curtis Taylor, Chagrin Falls, OH (US)

(73) Assignee: Maximum Production Solutions, Inc., Concord, NH (US)

( * ) Notice: Subject to any disclaimer, the term of this patent is extended or adjusted under 35 U.S.C. 154(b) by 17 days.

(21) Appl. No.: 10/737,158

(22) Filed: Dec. 15, 2003

(65) Prior Publication Data

US 2004/0262446 A1 Dec. 30, 2004

Related U.S. Application Data

(63) Continuation-in-part of application No. 10/378,176, filed on Mar. 3, 2003, now abandoned.

(60) Provisional application No. 60/433,931, filed on Dec. 17, 2002.

(51) Int. Cl.
*B65H 75/14* (2006.01)

(52) U.S. Cl. ..... 242/609.1; 242/613.5

(58) Field of Classification Search ..... 242/407.1, 242/607.1, 609.1, 613, 613.4, 613.5
See application file for complete search history.

(56) References Cited

U.S. PATENT DOCUMENTS 5,690,300 A * 11/1997 Iannucci ..... 242/571.2

* cited by examiner

*Primary Examiner*—John Q. Nguyen
(74) *Attorney, Agent, or Firm*—William B. Ritchie

(57) ABSTRACT

A reusable core that is suitable for having paper or other sheet material wound thereon. A multi-sectioned core is provided that is easily assembled. Interlocking sections that provide a pivot are held together by a sliding rod assembly inserted therein. One of type of rod assembly is preferable held into position by use of a snap ring or other similar fastening arrangement. A second type of rod assembly is a quick release design that can be easily pulled free by an integral handle. By removing the quick release rod, a key arcuate section is able to pivot thus causing the enabling the other two sections to likewise pivot inwardly, collapsing the core thereby permitting easy removal of the core from any remaining sheet material that must be discarded. The sheet material is held onto the core by means of a strip of double sided tape until the core is wound several times to keep the sheet material firmly in place.

7 Claims, 10 Drawing Sheets

REUSABLE COLLAPSIBLE CORE

This application is a continuation-in-part of U.S. patent application Ser. No. 10/378,176, filed Mar. 3, 2003, now abandoned which claims benefit of priority pursuant to 35 USC § 120 and also claims benefit of priority based on U.S. Provisional Application Ser. No. 60/433,931, filed Dec. 17, 2002, pursuant to 35 USC §119(e).

FIELD OF THE INVENTION

This invention relates to the field of winding cores, in particular, winding cores for use with paper, paper board, or other sheet material.

BACKGROUND OF THE INVENTION

Sheet material, such paper, fabric, plastic sheeting and the like is typically wound onto paper cores. For example, in the direct mail industry, paper mills wind their stock forms onto paper board cores for shipment to a direct mail printing facility. The forms come in various sizes; generally 25,000 forms or pages per roll. The press department then punches pin feeds into the paper. The press department then prints anything that may be consistent on the form such as letter head or form numbers for any given customer. During this process the form is unwound from the shipped roll and then wound onto another paperboard core. The core that came with the paper is customarily discarded when there is still some paper left on it . . . any where from 1" to 3" thickness of paper and then the core and paper is customarily discarded.

After the press punches pin feeds, prints letter head and rewinds the sheet forms, the roll is transferred to the laser printing department where the roll is unwound and rewound onto yet another core during the personalization process. (Names, addresses, phone numbers, letter information, etc.)

A direct mail facility that produces between 30 or 40 million names/addresses per month goes through between approximately 2,500 to 3,500 cores that are thrown into bins for recycling. Furthermore, there are more than 2,000 rolls with cores on the production floor waiting to go through the process at any given time.

Currently, winding cores are made of paper board and paper products. Their reuse is limited to several times, recycling and/or refurbishing the core so that it can be again used for winding material thereon. Double-sided tape is wrapped around the core in a "candy cane style" to adhere the sheet material to the core. Once the paper is completely wound onto the core, wooden plugs are pounded into the ends of the core to prevent it from collapsing from the weight of the load that was would upon it if the rolled material stays on the core for a considerable amount of time.

There is not found in the prior art a reusable core that will eliminate the need to throw away these rolls.

SUMMARY OF THE INVENTION

It is an aspect of the invention to provide a reusable core that is suitable for having paper or other sheet material wound thereon. A multi-sectioned core is provided that is easily assembled. Interlocking sections that provide a pivot are held together by a sliding rod inserted therein. By removing one rod between adjacent interlocking sections one of which is the key section, the core collapses thereby permitting easy removal. The sheet material is held onto the core by means of a strip of double sided tape until the core is wound several times to keep the sheet material firmly in place.

This aspect of the invention are not meant to be exclusive and other features, aspects, and advantages of the present invention will be readily apparent to those of ordinary skill in the art when read in conjunction with the appended claims.

DETAILED DESCRIPTION OF THE INVENTION

The invention is a reusable collapsible core that is useful for winding paper forms or other sheet material thereon. The core is preferably made of plastic but metal or hard rubber could also be used. The life span will be measured in years with little or no maintenance required.

Figure 1:
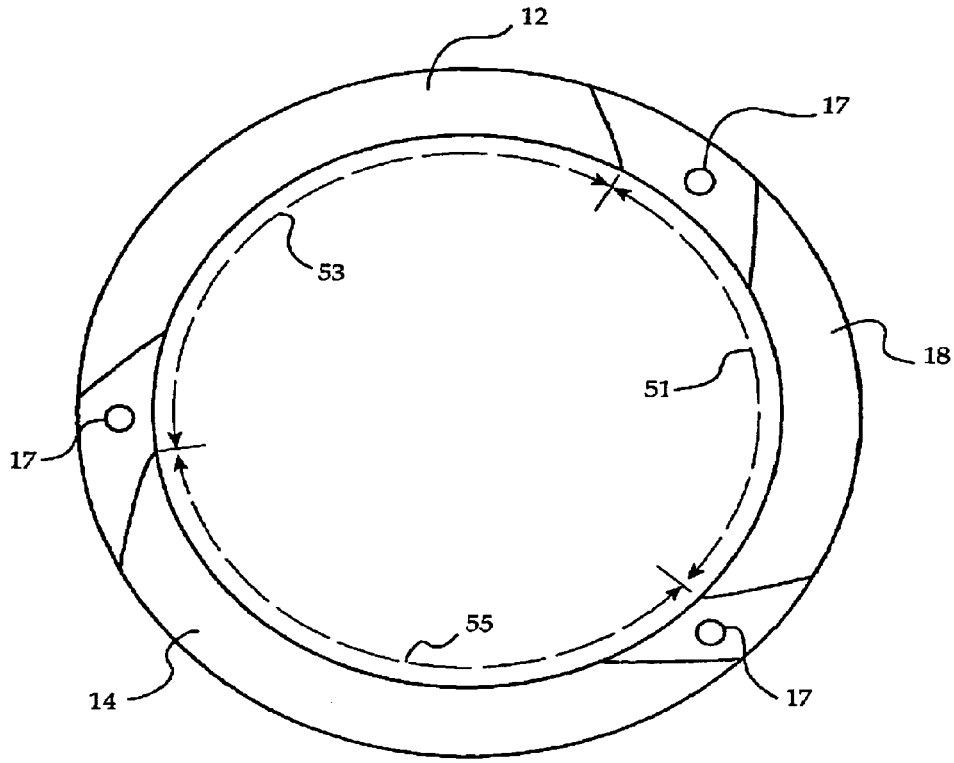
FIG. 1 is an end view of the preferred embodiment of the reusable collapsible core in accordance with the invention.

As shown in FIG. 1, invention 10 is assembled from three sections. First arcuate section 12 is substantially the same as second arcuate section 14. Note that arc length 53 of first arcuate section 12 is substantially the same length as the arc length 55 of second arcuate section 14. Also, note that arc length 51 of third section 18 is substantially less than the arc lengths 53, 55 of sections 12, 14 respectively. Each section can be manufactured from the same material or different materials. As noted above, plastic is the preferred material which is either injection molded or extruded. The assembled core is designed to allow for expansion and contraction of the cylinder outside diameter for the purpose of both allowing for the maximum cylinder circumference while winding rolled sheet materials and to allow for collapsing the invention for removal so that it can be used again. Three rod assemblies, a quick release rod assembly and two snap ring rod assemblies (described in detail below) are positioned through openings 17 to lock each section to its adjacent section as shown. Once the quick release rod assembly is removed, third section 18 is easily collapsed, thus collapsing the core and invention 10 can be removed from waste sheet material that is wound thereon as shown in FIG. 2.

Figure 2:
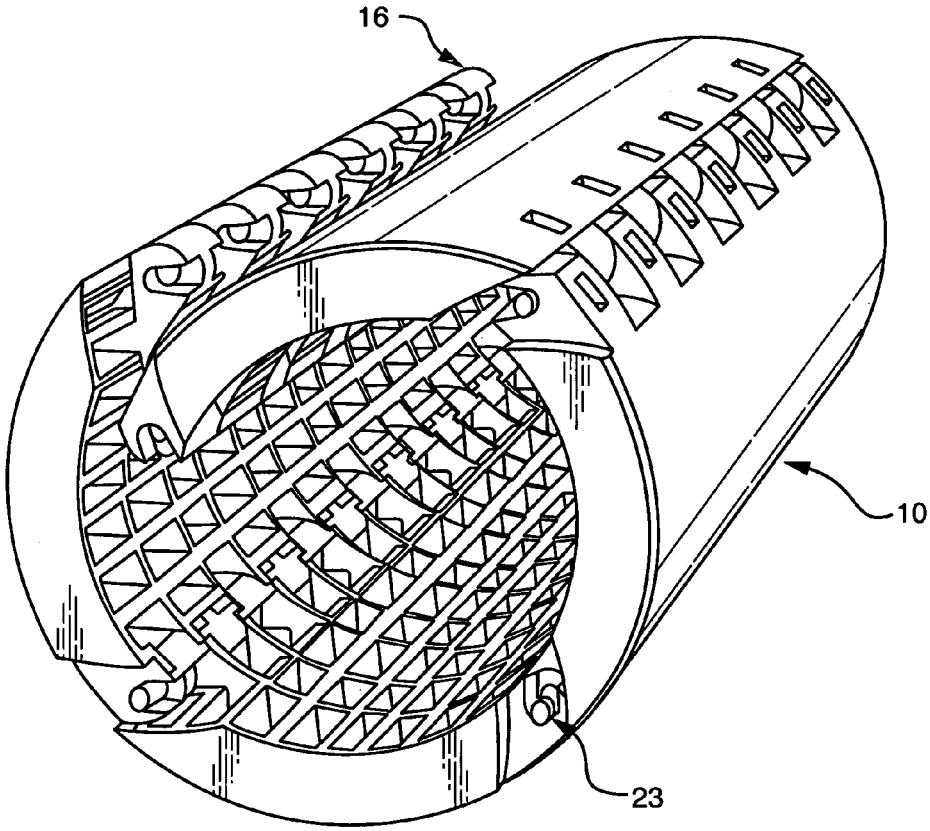
FIG. 2 is an isometric view of the core with one ton removed showing how the core is able to be collapsed; this view shows an alternative embodiment with four sections forming the core.

FIG. 2 shows an alternative embodiment of the invention using four arcuate sections, each being substantially the same including arc lengths.

Figure 3:
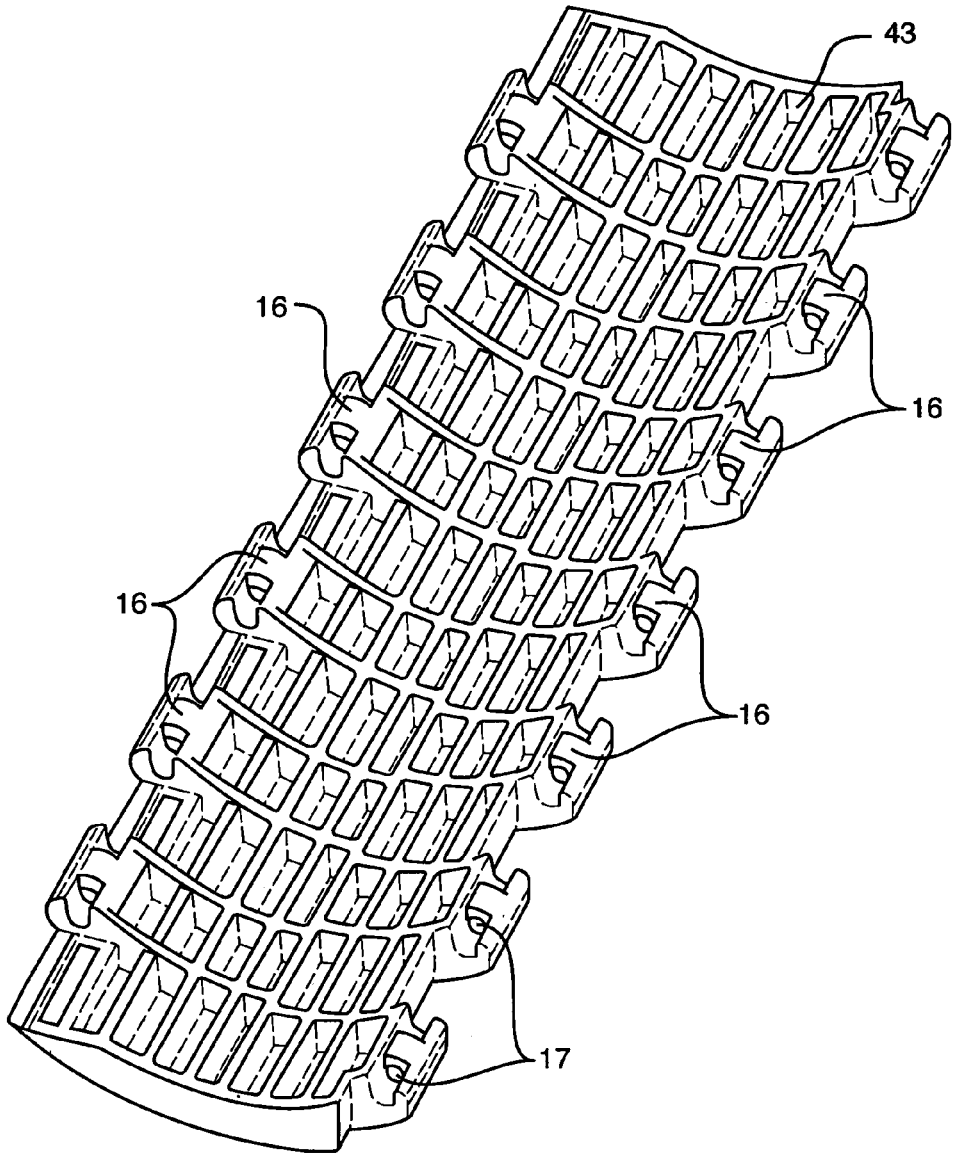
FIG. 3 is isometric bottom view of one section of the core.

The interior of each section of invention 10 is provided with a plurality of detents 43 as shown in FIGS. 2 and 3 which permit increase the structural integrity of the core without adding additional mass or cost of material. As shown, each arcuate section is provided with interlocking joint assembly 16 which meshes with an interlocking joint assembly 16 of an immediately adjacent section. Openings 17 in each interlocking joint assembly 16 are aligned to permit a rod to pass therethrough. When joined together, the sections form a cylindrical tube as shown in FIG. 1.

Figure 4:
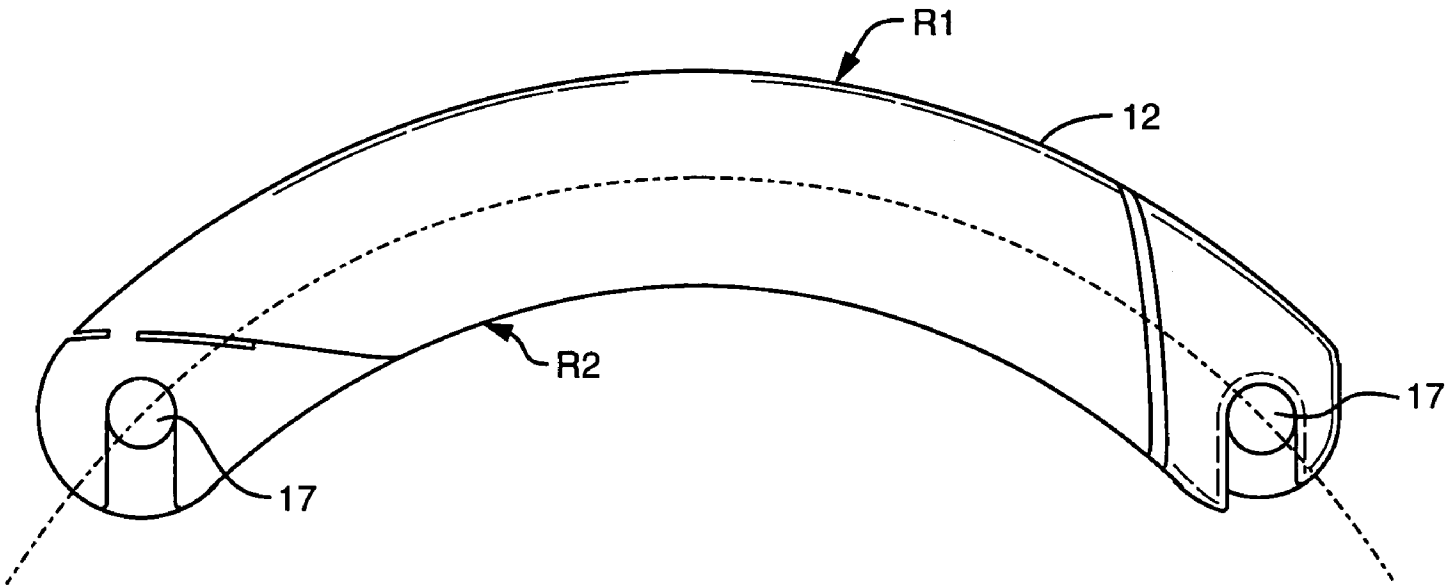
FIG. 4 is an end view of one section of the core.

As shown in FIG. 4, each section provides a portion of the circumference which corresponds to a mandrel (not shown) which invention 10 is placed thereon. Each arcuate section provides an arc of a circle having an outer radius R1 and an inner radius R2. Radius R2 is selected to fit onto the printing mandrel that is being used. The difference between R1 and R2 is selected based on the strength that the core must provide in to prevent it from collapsing until quick release rod assembly 44 (shown in FIG. 9) is removed from opening 17 so that invention 10 may be easily withdrawn from the remaining sheet material wrapped around the core. Then, the sheet material, usually paper, is discarded and invention 10 may be used again.

Figure 5:
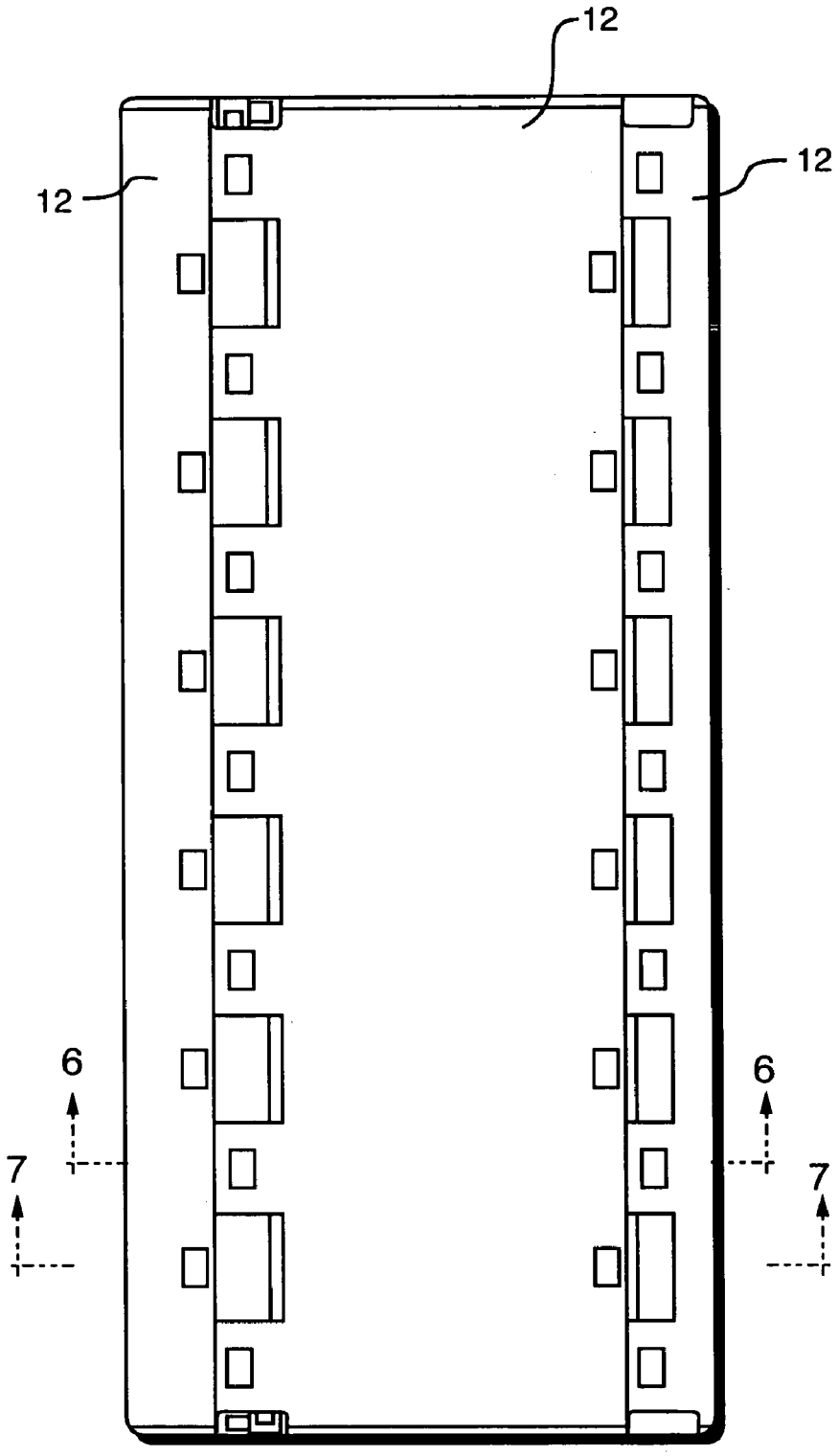
FIG. 5 is a top view of the core.

Referring to FIG. 5, a top of invention 10 is shown using first arcuate section 12 as a representative example. Second arcuate section 14 is substantially the same and third arcuate section 18 is likewise except that its arc length is substantially shorter. Together, arcuate sections 12, 14, and 18 provide the core when attached together with two snap ring rod assemblies 23 (shown in detail in FIG. 8) and one quick release rod assembly 44 (shown in FIG. 9).

Figure 6:
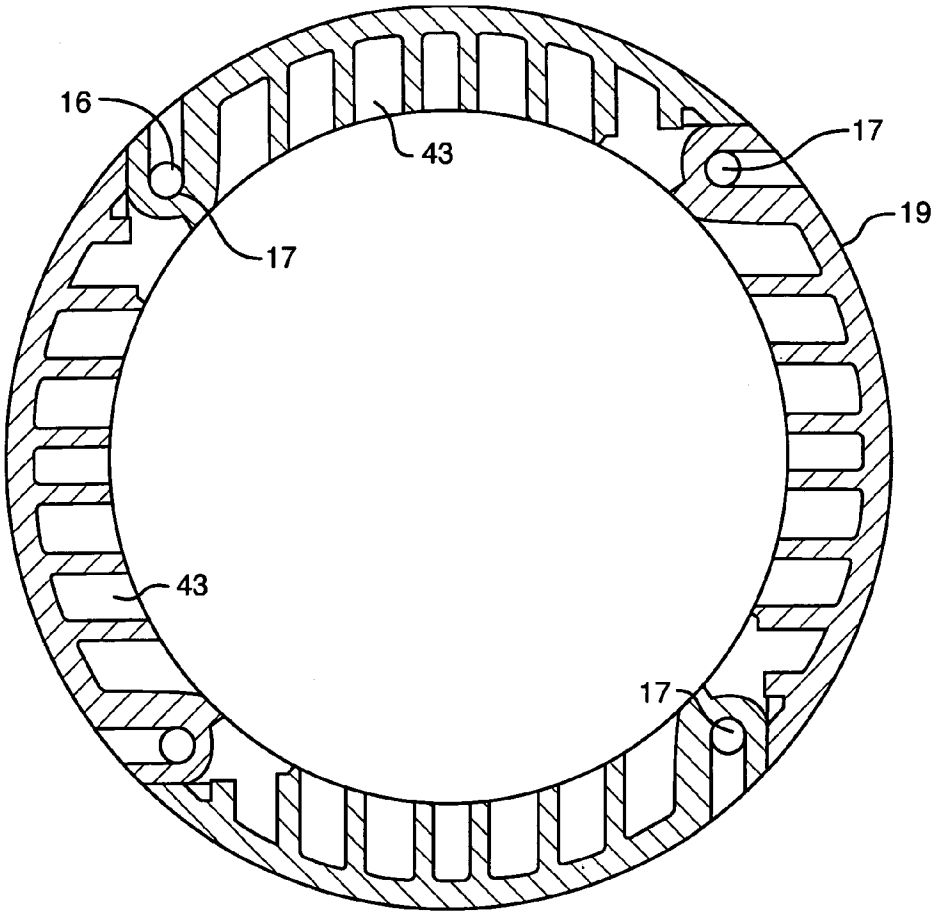
FIG. 6 is a cross-sectional view of one section of the core along line BB as shown in FIG. 5.
Figure 7:
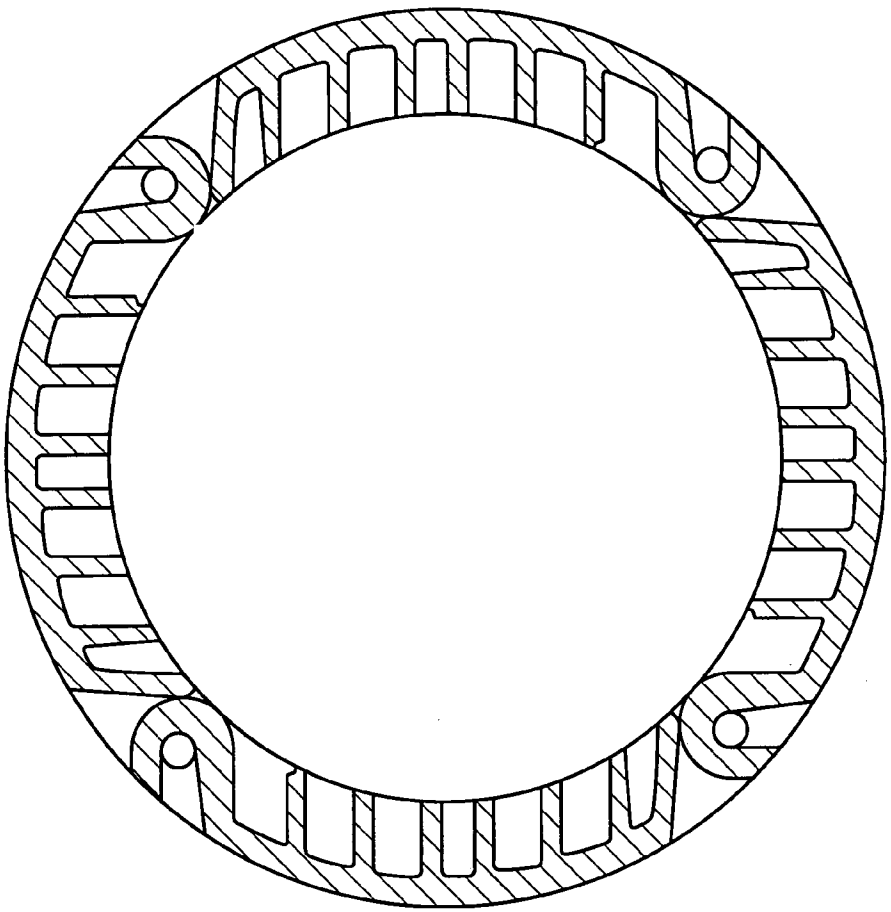
FIG. 7 is a cross-sectional view of one section of the core along line AA as shown in FIG. 5.

As shown in FIG. 6, the cross-sectional view of the alternative embodiment taken along line BB noted in FIG. 5, shows the plurality of detents 43 which to make each arcuate section egg-crate shaped in appearance as viewed from the inside. Each snap ring rod assembly 23 and one quick release rod assembly 44 is inserted through openings 17 in the respective sections to hold each section in place while sheet material (not shown) is wound onto surface 19. FIG. 7 shows a similar cross-sectional view taken along a different section line AA in FIG. 5.

Figure 8:
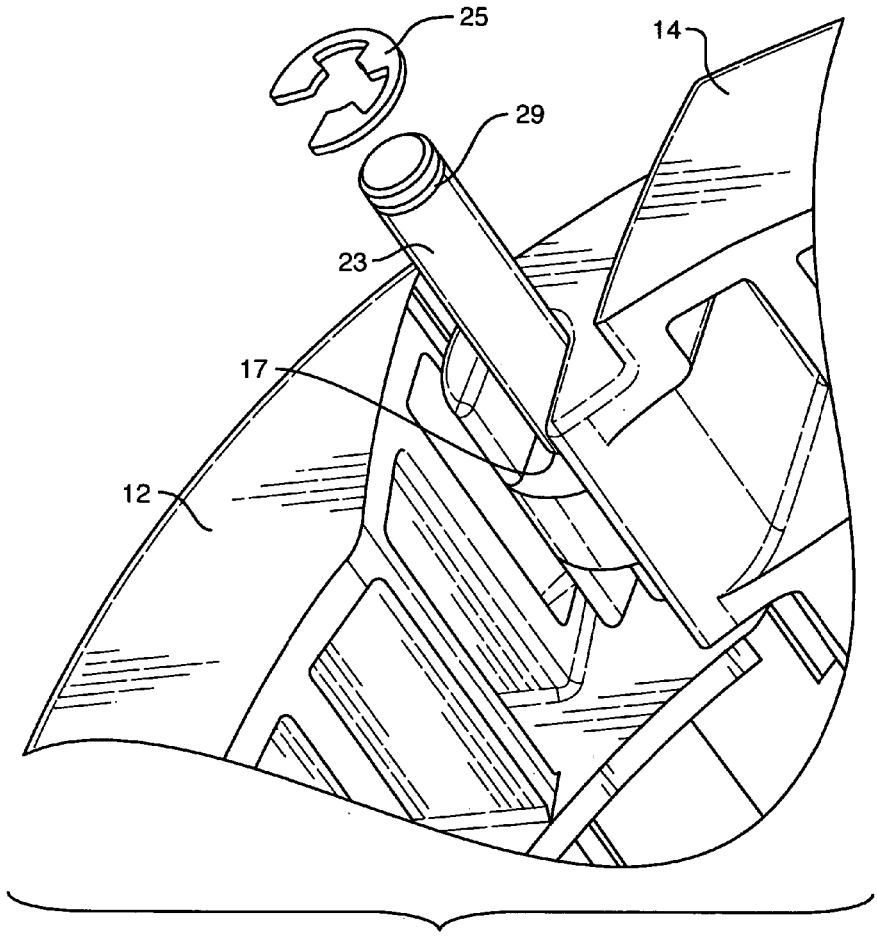
FIG. 8 is a detailed view of the snap ring rod interlocking assembly.

Referring to FIG. 8, a detail view of pin assembly 16 is provided. Snap ring rod assembly 23 is fed into openings 17 of interlocking sections and then held firmly in place via a snap ring 25 which fits into circumferential channel 29. Snap ring 25 is easily removed using snap ring pliers (not shown) which are well known in the art. While this is the preferred method of holding snap ring rod assembly 23 in position so that the held sections can pivot with respect to one another, other mechanisms well known in the art could be used as well.

Figure 9:
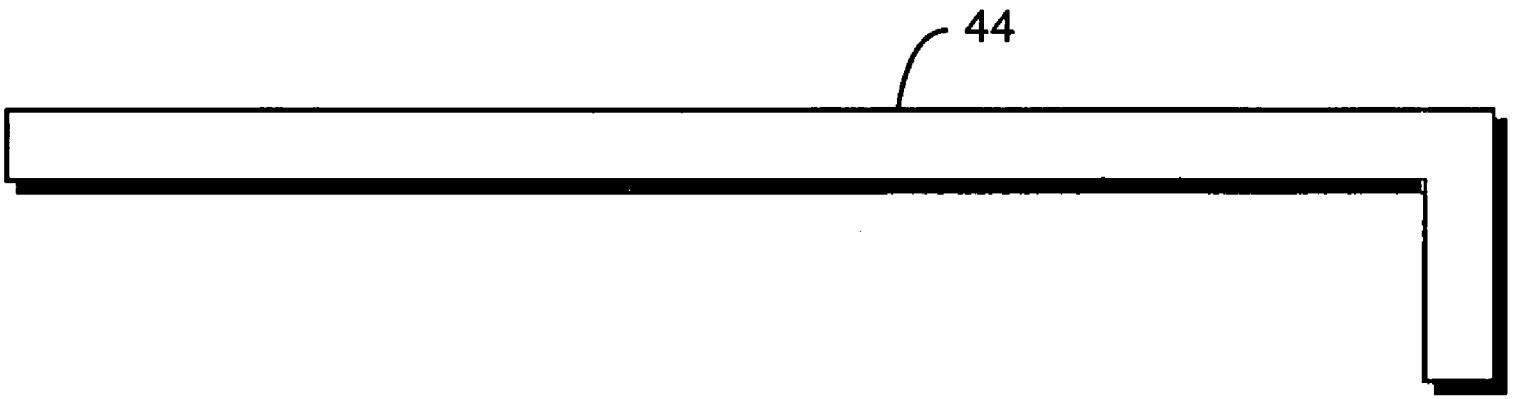
FIG. 9 is a detailed view of the quick release rod interlocking assembly.

Referring to FIG. 9, a detailed view of the quick release rod assembly 44 is shown. Assembly 44 is a rod that has a cross-section corresponding to opening 17 dimensions which preferable about 3/16 inches in diameter. A bend of about inch long at one end serves as a handle so that the assembly 44 can easily be inserted into openings 17 of the key arcuate section 18 and first arcuate section 12 to attached the two together and then quickly removed by pulling on the handle end of assembly 44 to remove assembly 44 so that the core can be collapsed.

Figure 10:
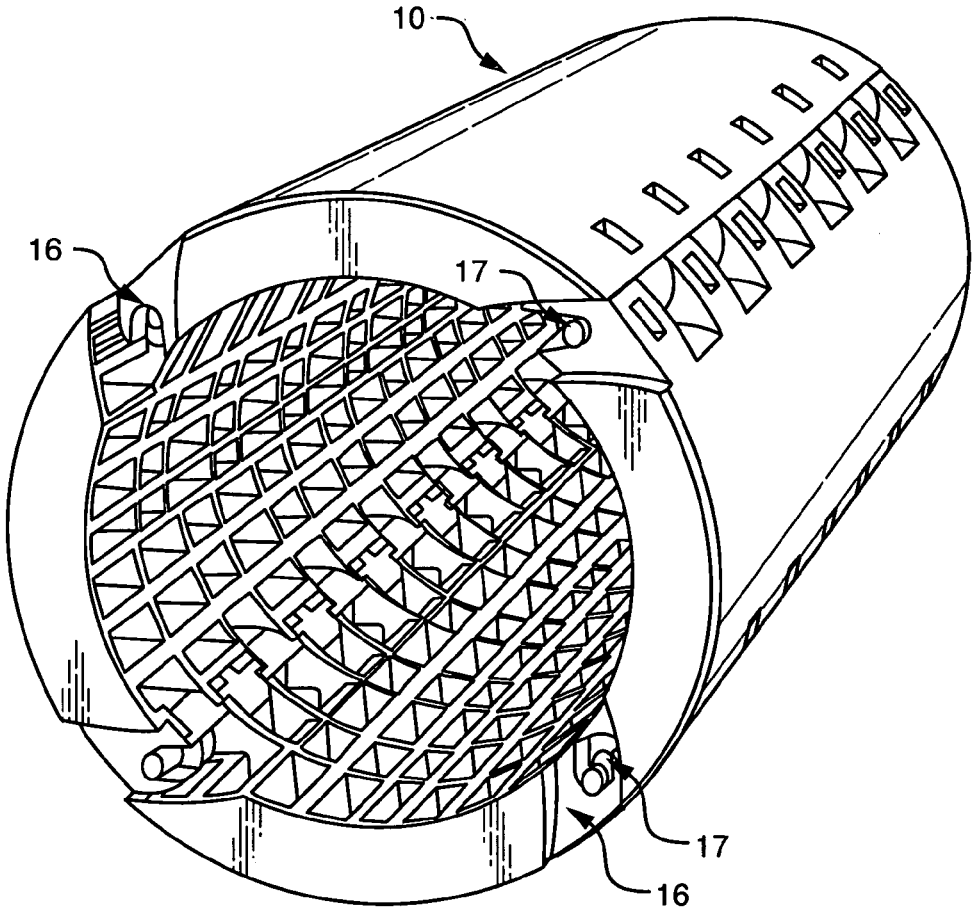
FIG. 10 is an isometric view of the reusable collapsible core showing the assembled four sections.

FIG. 10 shows an isometric view of the alternative embodiment. An isometric view of the preferred embodiment (not shown) would essentially the same, except three sections would be used to provide the core. As shown in this embodiment, each arcuate section has substantially the same arc radius, length and arc length.

The illustrated embodiments of the invention are intended to be illustrative only, recognizing that persons having ordinary skill in the art may construct different forms of the invention that fully fall within the scope of the subject matter disclosed herein. Other features and advantages of the invention will be apparent from the descriptions hereof.

What is claimed is:

1. A reusable collapsible core for winding sheet material thereon such that said reusable collapsible core with the sheet material wound thereon can be placed in a press having at least one mandrel with an outside radius and length, said reusable collapsible core comprising:

a first arcuate section having a predetermined inside arc radius and a predetermined length which respectively corresponds to the outside radius and length the mandrel of said press;

a second arcuate section having an inside arc radius and a predetermined length substantially the same as said first arcuate section and wherein said first and said second arcuate sections each having an arc length that is substantial the same;

a third arcuate section have inside arc radius and a predetermined length which is also substantially the same as said first and second arcuate sections and wherein said third arcuate section has an arc length that is substantially less than the arc length of said first and second sections such that the arc length of said first, second, and third arcuate sections when added together is substantially the same as the outside radius of said mandrel;

each arcuate section having a first and second interlocking joint assembly along longitudinal edges of each of said arcuate sections;

wherein the first interlocking joint assembly of said first arcuate section is attached to the second interlocking joint assembly of said second arcuate section; and wherein the second interlocking joint assembly of said first arcuate section is attached to the first interlocking joint assembly of said third arcuate section; and wherein the first interlocking joint assembly of said second arcuate section is attached to the second interlocking joint assembly of said third arcuate section; such that said reusable collapsible core is provided; and wherein releasing the first interlocking joint assemblies of said third arcuate section collapses said reusable collapsible core such that said core can be easily removed from the sheet material wound thereon.

2. The reusable collapsible core of claim 1 further comprising a quick release rod assembly that is inserted within the first interlocking joint assembly of said third arcuate section and the second interlocking joint assembly of said first arcuate section releasably locking said sections together such that said rod assembly can be easily removed to permit said core to collapse.

3. The reusable collapsible core of claim 2 wherein each of said arcuate sections has a thickness and an inside surface, wherein the inside surface of each of said arcuate sections further comprises a plurality of detents with each of said detents having a depth that is a substantial portion of the thickness of each of said arcuate sections comprising said reusable collapsible core.

4. The reusable collapsible core of claim 3 wherein each interlocking joint assembly has a plurality of aligned openings that define a path such a rod may be passed therethrough.

5. The reusable collapsible core of claim 2 wherein said quick release rod assembly comprises a rod having a right angle section that is positioned at one end of said rod such that the right angle section serves as handle to pull said quick release rod assembly free from the first interlocking joint assembly of said third arcuate section connected to the second interlocking joint assembly of said first arcuate section.

6. The reusable collapsible core of claim 5 further comprising a first snap ring rod assembly that attaches the first interlocking joint assembly of said first arcuate section to the second interlocking joint assembly of said second arcuate section and a second snap ring rod, substantially the same as said first snap ring rod, wherein said second snap rod assembly attaches the first interlocking joint assembly of said second arcuate section to the second interlocking joint assembly of said third arcuate section.

7. The reusable collapsible core of claim 6 wherein each of said snap ring rod assemblies further comprise circumferential channels at each end of each snap ring rod assembly and pair of snap rings that are placed on each pin assembly once a rod is inserted within aligned openings in each interlocking joint assemblies so that said arcuate sections may be joined together.

* * * * *